US005153954A

United States Patent [19]

Ohman

[11] Patent Number: 5,153,954

[45] Date of Patent: Oct. 13, 1992

[54] SYSTEM FOR SECURING A BLANKET TO A BUMPER PAD FOR SAFELY MAINTAINING COVERAGE OF A SLEEPING INFANT

[76] Inventor: Ross L. Ohman, 1176 Fernwood Ct., Shorewood, Minn. 55126

[21] Appl. No.: 827,711

[22] Filed: Jan. 29, 1992

[51] Int. Cl.[5] ..... A47G 9/04; A47D 15/00

[52] U.S. Cl. ..... 5/93.1; 5/494; 5/505.1; 5/923

[58] Field of Search ..... 5/494, 496, 498, 424, 5/425, 93.1, 505.1, 506.1, 922, 923

[56] References Cited

U.S. PATENT DOCUMENTS

| | | | |
|---|---|---|---|
| 1,474,738 | 11/1923 | Theirjung . | |
| 2,659,904 | 11/1953 | McGinnis . | |
| 2,677,137 | 5/1954 | Bergin . | |
| 2,700,778 | 2/1955 | Syracuse . | |
| 2,729,831 | 1/1956 | Fuld et al. . | |
| 2,838,770 | 6/1958 | Chezem . | |
| 2,870,463 | 1/1959 | Hoppe . | |
| 3,083,378 | 4/1963 | Pursell . | |
| 3,521,309 | 7/1970 | Evans . | |
| 3,570,026 | 3/1971 | Allison . | |
| 3,803,646 | 4/1974 | Newerowski | 5/93.1 |
| 4,646,375 | 3/1987 | Parker . | |
| 4,802,244 | 2/1989 | McGrath-Saleh | 5/494 |
| 5,010,611 | 4/1991 | Mallett . | |
| 5,103,514 | 4/1992 | Leach | 5/424 |

FOREIGN PATENT DOCUMENTS

| | | |
|---|---|---|
| 1445600 | 6/1966 | France . |

*Primary Examiner*—Alexander Grosz
*Attorney, Agent, or Firm*—Merchant, Gould, Smith, Edell, Welter & Schmidt

[57] ABSTRACT

A system for facilitating continued coverage of a sleeping infant comprising a blanket which can be secured and removably resecured to a bumper pad.

16 Claims, 2 Drawing Sheets

FIG. 1
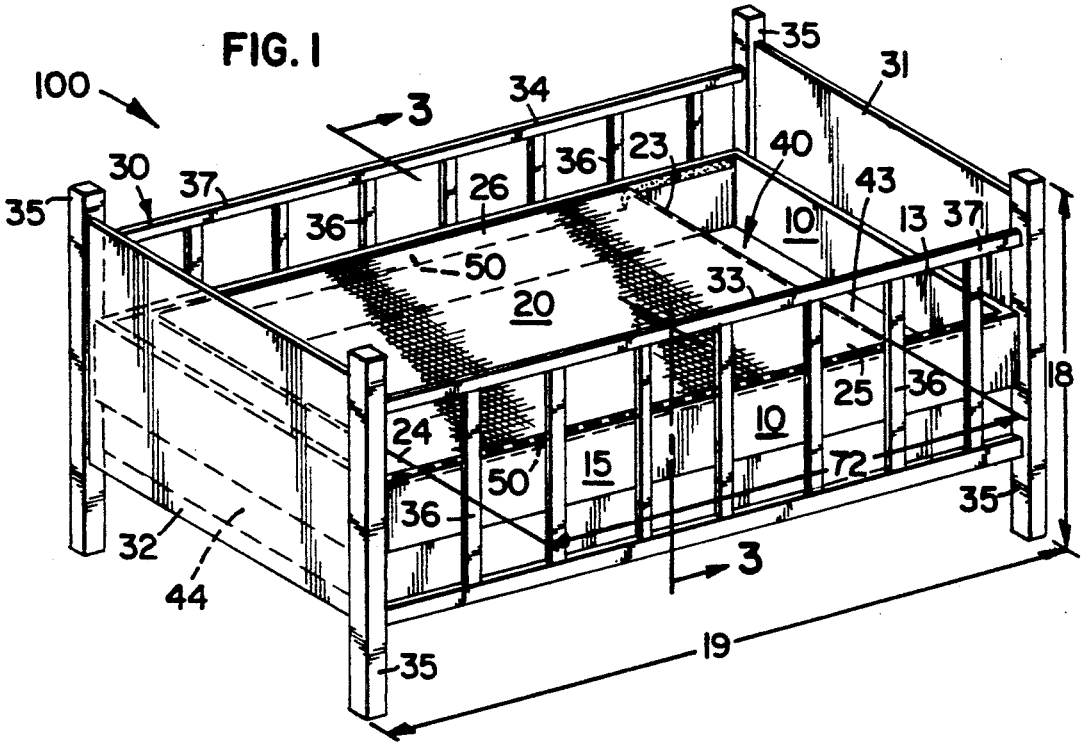
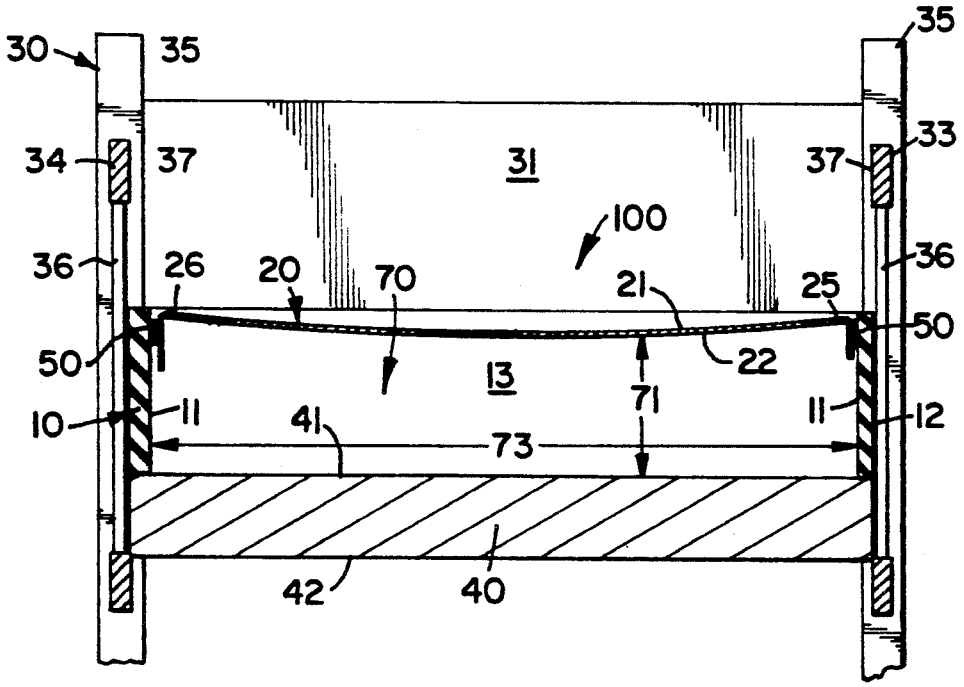
FIG. 3

SYSTEM FOR SECURING A BLANKET TO A BUMPER PAD FOR SAFELY MAINTAINING COVERAGE OF A SLEEPING INFANT

FIELD OF THE INVENTION

The invention broadly relates to blanket and bumper pad combinations used for protecting and comforting a sleeping infant. Specifically, the invention relates to a blanket which is secured to a bumper pad so as to prevent the infant from becoming uncovered or entangled within the blanket while providing the desired protection and comfort.

BACKGROUND OF THE INVENTION

The protection and comfort of an infant is a primary concern to parents. One area in which this concern is of primary importance is the sleeping conditions provided to the infant. Several problems are inherently encountered with sleeping infants. One of these problems is that infants typically shift significantly while sleeping such that they risk striking the sides of the crib, becoming uncovered and/or becoming entangled in any covering and/or padding provided within the crib. A parent may significantly reduce the risk of injury resulting from an infant striking the sides of the crib by simply providing some sort of padding against the walls of the crib. However, with respect to the other concerns, the only known procedure for reducing the risk associated therewith requires the concerned parents to frequently monitor the sleeping infant.

Several attempts have been made to address these problems with varying degrees of success.

Bergin, U.S. Pat. No. 2,677,137, discloses a crib sheet combination which includes a contoured mattress cover (bottom sheet) and a cover sheet (top sheet) wherein the cover sheet and mattress cover are sewn together along the foot and one side thereof and are removably attached along the other side.

Fuld et al., U.S. Pat. No. 2,729,831, discloses a system for securing a blanket to a mattress which includes (i) a sleeve for encasing the foot end of the mattress which includes snap halves positioned along the top, right side and left side of the mattress, and (ii) a blanket which includes [a] snap halves along the foot end thereof for coupling to the snap halves on the sleeve, and [b] ties along the right and left sides proximate the head end thereof for securing the blanket to the horizontal rails of the crib immediately underneath the mattress.

Hoppe, U.S. Pat. No. 2,870,463, discloses a system for securing a blanket to a mattress which includes (i) a first sleeve for encasing the foot of the mattress, (ii) a second sleeve for encasing the head end of the mattress which includes [a] snap halves positioned along the top of the mattress proximate one side of the mattress, and optionally [b] lengths of ribbon positioned along the sides of the mattress proximate the head end of the mattress, and (iii) a blanket which is stitched to the first and second sleeves along the right and left sides thereof and includes [a] snap halves positioned for attachment to the snap halves on the second sleeve, and [b] ties along the right and left sides proximate the head end thereof for securing the blanket to the rails of the crib and/or the ties on the second sleeve.

Pursell, U.S. Pat. No. 3,083,378, discloses a mattress sheet combination which includes a contoured mattress cover (bottom sheet) and a cover sheet (top sheet) wherein the cover sheet and mattress cover are releasably coupled together along the foot and both sides thereof.

Allison, U.S. Pat. No. 3,570,026, discloses a mattress sheet system which facilitates removal of that portion of the sheet contacted by the sleeping individual for laundering purposes and which includes (i) a contoured retainer which encircles the mattress while leaving the upper surface of the mattress uncovered, and (ii) a center panel releasably attachable to the retainer for covering the upper surface of the mattress.

Mallett, U.S. Pat. No. 5,010,611 discloses a combination contoured sheet and bumper pad for use in a crib wherein the lower edge of the bumper pad is permanently attached to the sheet along the entire periphery of the sheet.

While these previous concepts are effective for overcoming some of the difficulties outlined previously, they continue to suffer from one or more problems.

A first problem associated with such efforts to prevent the afore-mentioned problems associated with movement of a sleeping infant include an increase in the difficulty of properly securing the padding and/or coverings as necessary. Such efforts commonly require the completion of difficult and/or elaborate attachments of the various components to effect the desired results. This problem is commonly compounded when, due to space limitations, the crib is placed with one or more sides against a wall such that access to various components necessary to complete the required attachments is impeded.

A second problem which typically results from efforts to prevent the afore-mentioned problems caused by movement of a sleeping infant is an increase in the difficulty encountered in removing soiled linens from the crib due to the presence of the additional components.

A third problem associated with such efforts is the excessive cost of the system due, in large part, to the complexity of the design.

Accordingly, a strong need continues to exist for an inexpensive system which is (i) convenient to incorporate, use and remove, (ii) effective for reducing the chance that the infant can become entangled in any padding and/or covering used in the system, and (iii) effective for keeping sleeping infants covered.

SUMMARY OF THE INVENTION

The invention is a system effective for facilitating continued coverage of a sleeping infant with a blanket which includes (a) a blanket, (b) a longitudinally elongated, substantially planar bumper pad having a head section, a foot section, a first side section, and a second side section, (c) means for securing a first side of the blanket to the first side section of the bumper pad, and (d) means for securing the second side of the blanket to the second side section of the bumper pad. The system is effective for defining a sleeping space within which an infant may move while sleeping without disrupting the positioning of the blanket over the infant.

At least one of the securing means is desirably an unfastenable fastening means, such as hook and loop tape, for facilitating access to the sleeping space for positioning, repositioning and/or removing an infant from the sleeping space.

BRIEF DESCRIPTION OF THE DRAWINGS

FIG. 1 is a perspective view of one embodiment of the present invention illustrating the system in combination with a standard mattress and crib.

FIG. 3 is a cross-sectional view of FIG. 1 taken along lines 3—3.

DETAILED DESCRIPTION OF THE INVENTION INCLUDING A BEST MODE

Definitions

Figure 2:
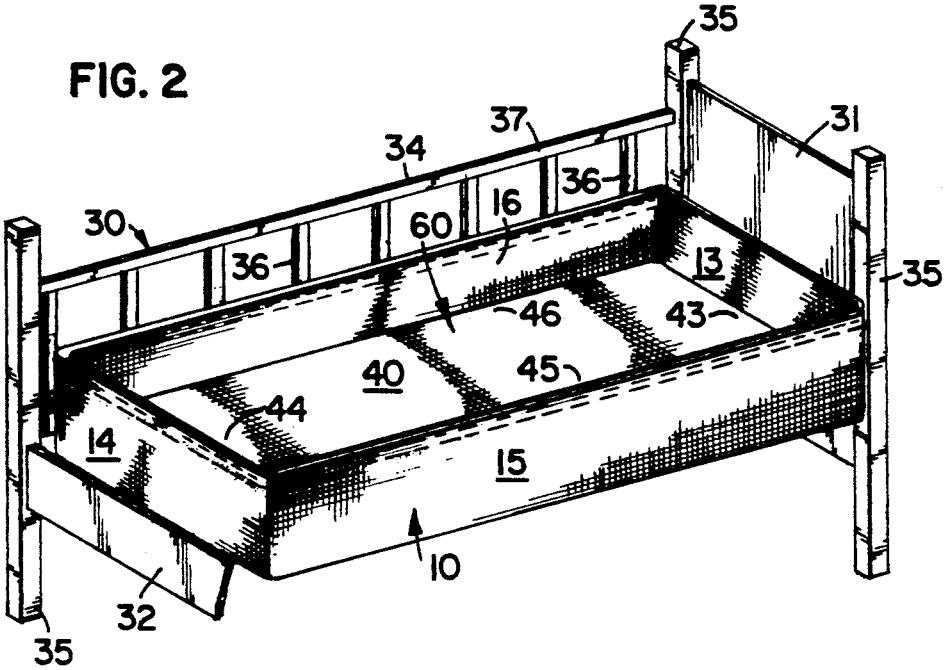
FIG. 2 is a duplicate of FIG. 1 with portions thereof removed for purposes of depicting additional components.

As utilized herein, including the claims, the term "bumper pad" means a padding material, such as fleece or a batted fabric, which is configured and arranged for placement within a crib along at least the right and left sides of the mattress, generally along the entire periphery of the mattress, for vertically covering and cushioning the head board, foot board and/or side railings of the crib. An assessment of whether padding material is a "bumper pad" is not influenced by type, location, and/or extent of any permanent and/or temporary attachment of the padding material to a mattress, contoured sheet, crib railing, or the like.

As utilized herein, including the claims, the term "cover" or "covering" means a substantially planar, breathable, pliable article effective for being placed over and/or about an individual for the purpose of insulating the individual from the surrounding environment and includes specifically, but not exclusively, fabric blankets, fabric sheets, insulated blankets, and waterproof laminates.

As utilized herein, including the claims, the term "fixed", when used in connection with a securing and/or attachment means, indicates permanent attachment which is not intended to permit repeated detachment and reattachment. Exemplary of such "fixed" securing and/or attachment means include specifically, but not exclusively, adhesives, sewing, and staples.

As utilized herein, including the claims, the term "infant", includes newborns, babies, toddlers, and children.

As utilized herein, including the claims, the term "patch", when used in connection with hook and loop tape, means a relatively small piece of hook and loop tape which is of sufficient size to be effective for achieving the desired attachment. Exemplary of such "patches" include specifically, but not exclusively, circles, ovals, rectangles, triangles, and elongated strips.

As utilized herein, including the claims, the term "sleeping surface" means that substantially horizontal surface physically contacted by a sleeping individual and includes specifically, but not exclusively, the upper surface of a mattress, the upper surface of a foam pad, the upper surface of a cushion, and the upper surface of a fabric covered box spring.

As utilized herein, including the claims, the term "sleeping chamber" means that space defined by the sleeping surface of a matress and vertical structures extending upward from the sides of the matress. The sleeping chamber includes (i) a height dimension delimited by the sleeping surface and the height of the vertical side strutures, (ii) a length dimension delimited between the head ends and foot ends of the vertical side structures, and (iii) a width dimension delimited between the vertical side structures. This sleeping chamber provides a volume within which the infant may be positioned such that movement will be restricted so as to prevent the infant from accidentally falling from the sleeping surface of the mattress.

As utilized herein, including the claims, the term "sleeping space" means that space between the cover 20 and the sleeping surface 41. A sleeping space includes (i) a height dimension 71 delimited by the sleeping surface 41 and the cover 20, (ii) a length dimension 72 delimited by the head end 23 of the cover 20 and the shorter of the foot end 24 of the cover 20 and the foot board 32 of the crib frame 30, and (iii) a width dimension 73 delimited by the first side section 15 of the bumper pad 10 and the second side section 16 of the bumper pad 10. This sleeping space 70 provides a volume within which the infant may move while sleeping without disrupting the positioning of the cover 20 over the infant.

Nomenclature

10: bumper pad
11: bumper pad, inner surface
12: bumper pad, outer surface
13: bumper pad, head section
14: bumper pad, foot section
15: bumper pad, first side section
16: bumper pad, second side section
18: lateral length
19: longitudinal length
20: cover
21: cover, upper surface
22: cover, lower surface
23: cover, head
24: cover, foot
25: cover, first side
26: cover, second side
30: crib frame
31: crib frame, head board
32: crib frame, foot board
33: crib frame, first side railing
34: crib frame, second side railing
35: crib frame, corner post
36: crib frame, vertical rail
37 crib frame, horizontal top rail
40: mattress
41: sleeping surface
42: mattress, lower surface
43: mattress, head
44: mattress, foot
45: mattress, first side
46: mattress, second side
50: hook and loop tape
51: hook portion of hook and loop tape
52: loop portion of hook and loop tape
60: sleeping chamber
70: sleeping space
71: height dimension
72: length dimension
73: width dimension
100: system

Discussion

Referring to FIG. 1, a bumper pad 10 is configured and arranged within the sleeping chamber 60 defined by a crib frame 30 so as to cover that portion of the head board 31, foot board 32, first side railings 33 and second side railings 34, of the crib frame 30 immediately above the sleeping surface 41 of the mattress 40 retained therein.

The bumper pad 10 includes a head section 13, a foot section 14, a first side section 15, and a second side section 16. The sections 13,14,15,16 of the bumper pad 10 are configured and arranged such that the head section 13 of the bumper pad 10 extends along the periphery of the head 43 of the mattress 40, the foot section 14 of the bumper pad 10 extends along the periphery of the foot 44 of the mattress 40, the first side section 15 of the bumper pad 10 extends along the periphery of the first side 45 of the mattress 40, and the second side section 16 of the bumper pad 10 extends along the periphery of the second side 46 of the mattress 40.

A cover 20 is attached to the bumper pad 10 with the first side 15 of the cover 20 attached to the first side 25 of the bumper pad 10 and the second side 16 of the cover 20 attached to the second side 26 of the bumper pad. Such a configuration serves to suspend the cover 20 above the sleeping surface 41 of the mattress 40 and thereby define a sleeping space 70 between the cover 20 and the mattress 40. One of the sides may be permanently attached, such as by sewing, but at least one of the sides must be releasably attached. For purposes of facilitating continued discussion of the present invention, the specification shall hereinafter be based upon releasable attachment of the cover 20 to the bumper pad 10 on both the first 15,25 and second 16,26 sides thereof.

The means for removably attaching the cover 20 to the bumper pad 10 may be any of the well recognized means for effecting such an attachment including specifically, but not exclusively, buttons, hook and eye, hook and loop tape, snaps, and zippers. Because of the simplicity of operation and lack of "metallic" components, the attaching means of choice is hook and loop tape. Accordingly, for purposes of facilitating continued discussion of the present invention, the specification shall hereinafter reference hook and loop tape and the attaching means.

The sides 25,26 of the cover 20 are removably attached to the sides 15,16 of the bumper pad 10 respectively by means of hook and loop tape 50. The hook portion 51 and loop portion 52 of the hook and loop tape 50 are permanently attached to the bumper pad 10 and the cover 20. Selection as to which portion of the hook and loop tape 50 is attached to the bumper pad 10 and which is attached to the cover 20 is substantially irrelevant with respect to operability of the system 100. However, since the hook portion 51 of the hook and loop tape 50 is stiff and susceptible to collecting extraneous particles which interfere with continued coupling of the hook portion 51 to the loop portion 52, the hook portion 51 is preferably attached to the bumper pad 10 which generally remains attached to the crib frame 30 while the loop portion 52 is attached to the cover 20 which is readily detachable for continued use throughout the day.

The hook and loop tape 50 may be provided in substantially any configuration which is effective for maintaining continued attachment of the cover 20 to the bumper pad 10. Exemplary of such configurations include specifically, but not exclusively, continuously extending lateral 18 and/or longitudinal 19 lengths, patches, and single pieces sufficient to completely cover the specified surface.

Figure 4:
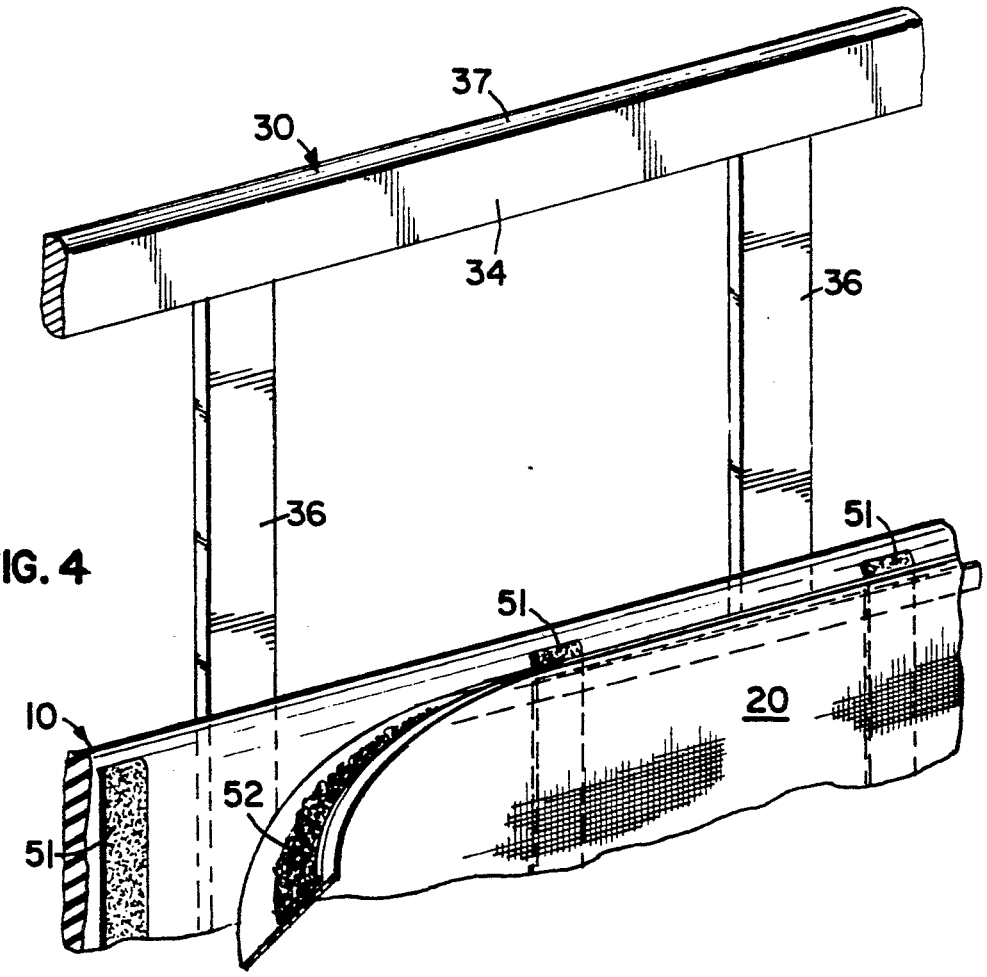
FIG. 4 is an exploded perspective view of a portion of a second embodiment of the present invention in combination with a standard crib.

Referring to FIG. 4, laterally extending lengths of the hook portion 51 of hook and loop tape 50 are longitudinally spaced along the first 15 and second 16 side sections of the bumper pad 10 as a means for permitting the height 71 of the sleeping space 70 to be readily adjusted in order to accommodate differently sized infants. Other configurations of the hook and loop tape 50 may be employed to achieve such "height adjustability" including longitudinally extending lengths of the hook portion 51 of hook and loop tape 50 laterally spaced along the first 15 and second 16 side sections of the bumper pad 10; covering the entire first 15 and second 16 side sections of the bumper pad 10 with the hook portion 51 of hook and loop tape 50; etc.

An alternative to the use of hook and loop tape 50 is to use only the hook portion 51 of hook and loop tape 50 on the bumper pad 10 and construct the cover 20 from a "loop-type" material, such as fleece, which is effective for being attached to the hook portion 51.

Operation

A sleeping infant, wrapped within the cover 20, may be placed within the crib frame 30 and the system 100 utilized by (i) approaching the crib from the most convenient side of the crib frame 30 which includes the releasable securing means (hook and loop tape 50), (ii) gently placing the infant on the sleeping surface 41, (iii) spreading the cover 20 across the sleeping surface 41 and over the sleeping infant, and (iv) securing the cover 20 to the bumper pad 10 using the securing means (hook and loop tape 50).

The height 71 of the sleeping space 70 may be adjusted by simply attaching the cover 20 to the bumper pad 10 in step (iv) at a different lateral position along the bumper pad 10.

The specification is intended to aid in a complete and unlimited understanding of the invention. Since various embodiments of the invention may be made without departing from the spirit and scope of the invention, the scope of the invention lies in the claims hereinafter appended.

I claim:

1. A system for facilitating continued coverage of at least the lower body portions of a sleeping infant with a cover, comprising:

(a) a planar cover having a head end, a foot end, a first side and a second side, (b) a longitudinally elongated, bumper pad, placeable on a generally horizontal sleeping surface and defining an inner surface and an outer surface and having at least a first side section, and a laterally spaced second side section, (c) means for securing the first side of the cover to the inner surface of the first side section of the bumper pad, and (d) means for securing the second side of the cover to the inner surface of the second side section of the bumper pad, wherein the system is effective for defining a sleeping space defined by the sleeping surface, the inner surfaces of the side sections of the bumper pad and the cover.

2. The system of claim 1 wherein (i) the sleeping space has a height dimension, and (ii) at least one of the fastening means is effective for permitting attachment of the cover to the bumper pad at multiple positions along the lateral length of the bumper whereby variations in the height of the sleeping space may be effected.

3. The system of claim 1 wherein at least one of the securing means comprises an unfastenable fastening means.

4. The system of claim 3 wherein the unfastenable fastening means comprises hook and loop tape wherein the hook portion of the tape is secured to the cover and the loop portion of the tape is secured to the inner surface of the bumper pad.

5. The system of claim 4 wherein the hoop portion secured to the cover extends continuously along substantially the entire longitudinal length of the cover proximate the first side thereof.

6. The system of claim 5 wherein the loop portion secured to the bumper pad extends continuously along substantially the entire longitudinal length of the first side section of the bumper pad.

7. The system of claim 5 wherein the loop portion secured to the bumper pad comprises separate pieces of the loop portion longitudinally spaced along the first side section of the bumper pad.

8. The system of claim 4 wherein the hook portion secured to the cover comprises separate pieces of the hook portion longitudinally spaced along the first side of the cover.

9. The system of claim 3 wherein the unfastenable fastening means comprises hook and loop tape wherein the loop portion of the tape is secured to the cover and the hook portion of the tape is secured to the inner surface of the bumper pad.

10. The system of claim 9 wherein the loop portion secured to the cover extends continuously along substantially the entire longitudinal length of the cover proximate the first side thereof.

11. The system of claim 10 wherein the hook portion secured to the bumper pad extends continuously along substantially the entire longitudinal length of the first side section of the bumper pad.

12. The system of claim 10 wherein the hook portion secured to the bumper pad comprises separate pieces of the hook portion longitudinally spaced along the first side section of the bumper pad.

13. The system of claim 9 wherein the loop portion secured to the cover comprises separate pieces of the loop portion longitudinally spaced along the first side of the cover.

14. The system of claim 1 wherein one of the securing means comprises an unfastenable fastening means and the other securing means comprises a fixed fastening means.

15. The system of claim 1 wherein the securing means comprises the hook portion of hook and loop tape secured along the first side section of the bumper pad and the cover comprises a material effective for being unfastenably fastened to the hook portion.

16. A system for facilitating continued coverage of a sleeping infant with a blanket, comprising:

(a) a crib having a vertical head wall, a vertical foot wall, a vertical first side wall and a vertical second side wall wherein the walls of the crib define an enclosure, (b) a mattress horizontally retained within the enclosure and having an upper surface, a lower surface, a head end proximate the head wall, a foot end proximate the foot wall, a first side proximate the first side wall and a second side proximate the second side wall, (c) a blanket having a head end, a foot end, a first side and a second side, (d) a longitudinally elongated bumper pad configured and arranged within the enclosure so as to cover the walls of the crib immediately above the mattress wherein the bumper pad has an inner surface, an outer surface, a head section covering the head wall, a foot section covering the foot wall, a first side section covering the first side wall and a second side section covering the second side wall, (e) means for releasably securing the first side of the blanket to the inner surface of the first side section of the bumper pad, and (f) means for securing the second side of the blanket to the inner surface of the second side section of the bumper pad, wherein the system is effective for defining a sleeping space having (i) a height dimension delimited by the upper surface of the mattress and the blanket, (ii) a length dimension delimited by the head of the blanket and the shorter of the foot of the blanket and the foot wall of the crib, and (iii) a width dimension delimited by the first side section of the bumper pad and the second side section of the bumper pad.

* * * * *

UNITED STATES PATENT AND TRADEMARK OFFICE

CERTIFICATE OF CORRECTION

PATENT NO. : 5,153,954

DATED : October 13, 1992

INVENTOR(S) : Ohman

It is certified that error appears in the above-identified patent and that said Letters Patent is hereby corrected as shown below:

In Col. 7, Line 9, delete the word "hoop" and insert therefor --hook--.

Signed and Sealed this

Twenty-second Day of March, 1994

*Attest:*

Bruce Lehman

BRUCE LEHMAN

*Attesting Officer*

*Commissioner of Patents and Trademarks*